United States Patent [19]

McGowan et al.

[11] 4,149,798

[45] Apr. 17, 1979

[54] ELECTROPHOTOGRAPHIC APPARATUS AND METHOD FOR PRODUCING PRINTING MASTERS

[75] Inventors: Norman L. McGowan, Romoland, Calif.; William Jeffers, Fair Haven, N.J.; Richard E. Amtower, Laguna Niguel, Calif.; Klaus-Peter Schoen, Wiesbaden, Fed. Rep. of Germany

[73] Assignee: Eocom Corporation, Irvine, Calif.

[21] Appl. No.: 805,373

[22] Filed: Jun. 10, 1977

[51] Int. Cl.[2] ..... G03G 15/28

[52] U.S. Cl. ..... 355/8; 96/1 R; 355/3 R; 355/133

[58] Field of Search ..... 355/1, 3 R, 8, 73, 133; 96/1 R

[56] References Cited

U.S. PATENT DOCUMENTS

| | | | |
|---|---|---|---|
| 3,040,621 | 6/1962 | Crumrine | 355/73 X |
| 3,316,348 | 4/1967 | Hufnagel et al. | 358/109 |
| 3,776,629 | 12/1973 | Ogawa | 355/8 |
| 3,898,627 | 8/1975 | Hooker et al. | 355/3 R X |
| 3,970,359 | 7/1976 | Starkweather | 355/8 X |
| 4,002,829 | 1/1977 | Hutchison | 358/286 |
| 4,006,984 | 2/1977 | Friese | 355/73 X |
| 4,046,471 | 9/1977 | Branham et al. | 355/3 R X |

*Primary Examiner*—Fred L. Braun

*Attorney, Agent, or Firm*—Michael J. Tully

[57] ABSTRACT

An electrophotographic apparatus for producing printing masters utilizing modulated laser light as the exposure source and a continuous process for producing such printing masters involving the steps of plate conveyance, synchronous charging and exposure, and electrostatic development and fusing of electrophotographic printing masters suitable for use in offset or lithographic printing processes. The apparatus comprises a transport system for sequentially conveying printing masters to the exposure platen which retains the masters in a fixed plane for synchronous charging and exposure, utilizing as a light source, a modulated laser beam. The optical and deflecting components of the exposure system are mounted in a moveable carriage member adapted to traverse a plane substantially parallel to the plane of the exposure platen such that the exposure laser will raster scan the platen area. The charging coratron is also preferably mounted on the moveable carriage such that the sequence of charging the electrophotographic master and exposure thereof to the raster scan of the exposure laser are synchronous. The apparatus employs an exposure laser having a power of about less than 1 watt, but sufficient power to provide a light energy on the photoconductive surface of the printing master of at least about $2\times10^{-3}$ millijoules/cm$^2$ under operating conditions.

15 Claims, 5 Drawing Figures

ELECTROPHOTOGRAPHIC APPARATUS AND METHOD FOR PRODUCING PRINTING MASTERS

BACKGROUND OF THE INVENTION

The present invention relates to a high speed automated machine for the manufacture of printing masters by electrophotographic means utilizing modulated laser light as the exposure means.

Significant advances in the art of printing plate technology have occurred in recent years. Printing masters such as have been employed in lithographic offset or direct printing processes are normally prepared by the imagewise exposure of a photosensitive coating which has been applied to a suitable support. Typical of such coatings are the so-called positive acting diazos, as for example disclosed in German Patent Specification No. 854,890, which undergo photodecomposition in the areas of the coating exposed to a source of actinic light, which exposed areas may subsequently be removed by treatment with a liquid developer solution in which only the photodecomposed areas are soluble. The negative acting coatings, on the other hand, undergo a photohardening or photopolymerization in those areas exposed to actinic light and only the unexposed areas of the coating are subsequently removed by appropriate developer. Representative of such negative acting materials are para quinone diazides such as disclosed in German Patent Specification No. 960,335, or condensation products of diazonium salts such as disclosed in U.S. Pat. Nos. 3,679,419; 3,867,147; and 3,849,392.

Offset plates have also been prepared by electrophotographic methods. Such plates are normally composed of a photoconductive material such as zinc oxide or cadmium sulfide dispersed in an ink-repelling binder material and coated on a suitable base material such as paper, metal or a film. These plates are imaged by the normal electrophotographic process involving forming an electrostatic charge on the surface of the plate, exposing the charged plate on an electrically conductive support to an image pattern of electromagnetic radiation, developing the resulting electrostatic image pattern by contact with an electroscopic liquid or solid developer, and fixing the developed image by drying or heating. The resultant imaged plate may be then used as a master for offset lithographic printing. An example of a machine for automatically performing such an electrophotographic process is disclosed in U.S. Pat. No. 4,006,984.

Because of the increased use in recent years of electronic methods for recording, storing and/or generating information such as by computers, cathode ray tubes, facsimile devices and the like, there have been some advances in the modification of the state of the printing plate art and the compatibilization of plate making processes with the newer technology for generating image information. For example, U.S. Pat. No. 3,549,733 discloses the use of a modulated high intensity 30 watt carbon dioxide gas laser to image a printing plate wherein polymeric material on the plate surface is decomposed to form ridgeless depressions, thus forming a relief plate. U.S. Pat. No. 3,506,779 discloses a laser beam typesetting apparatus for forming relief plates wherein a high intensity 100 watt carbon dioxide laser is utilized to remove plate material from the plate surface by vaporization. U.S. Pat. No. 3,664,737 teaches a printing plate recording system involving direct laser exposure of diazo sensitized printing plates which are subsequently developed by conventional development methods. An example of a process for manufacturing printing masters by photochemical means utilizing a relatively high powered 15 watt exposure laser is the LASERITE® system of the Eocom Corporation of Irvine, Calif., which process is described in the Mar. 10, 1975 publication, "The Seybold Report" by Seybold Publications.

In spite of the advanced made in the automation of platemaking technology, most of the processes and apparati presently available which utilize modulated laser light as the source of light exposure are relatively slow with regard to their platemaking capability, requiring anywhere in the range of about 2 to 40 minutes or more to process a single unexposed master into a finished plate ready for offset printing. Also, many of the known processes and machines rely on the use of relatively high powered output lasers, i.e. greater than 1 watt and often 15 watts or more, in order to accomplish the work of exposing, etching or deforming plate surfaces. Aside from the high energy requirements of such lasers, there are attendant problems in providing adequate cooling means which adds bulk and expense to the apparatus in which such lasers are embodied.

Also, in a system such as disclosed in U.S. Pat. No. 4,006,984, referred to above, electrophotographic plates are charged by mechanically passing a corona charging device such as known in the art over the surface of the plate, after which the plate is exposed by a full frame photographic exposure. Because the entire plate surface is exposed at once, the decay of electrostatic charge on the plate surface is of little moment. However, with a raster scan laser system wherein the laser scan line advances slowly over the plate surface, some of the electrostatic charge present on the end of the plate opposite the advancing scan line may decay prior to exposure, resulting in a noticeable image density differential in the copy after development.

Accordingly, it is an object of this invention to provide an electrophotographic imaging process and apparatus for producing printing masters utilizing modulated laser light as the exposure means.

Another object is to provide an apparatus for the electrophotographic production of finished printing masters at the rate of about one master per minute.

Another object is to provide an apparatus which is adapted to automatically convey, electrostatically charge, laser expose, electrostatically develop and finish electrophotographic printing masters for use in offset or lithographic printing processes.

SUMMARY OF THE INVENTION

These and other objects of the invention are achieved by providing an integrated electrophotographic machine for preparing visible images on a printing master having a photoconductive insulating surface and in a continuous or semi-continuous manner comprising:

(1) an exposure platen adapted to securely retain and unexposed printing master in a plane and means for automatically conveying individual unexposed printing masters from a stacking area to said platen;

(2) means for generating an exposure laser beam and associated optical means for deflecting and scanning said beam along a predetermined path to line scan a portion of the photoconductive surface of a printing master retained on said exposure platen;

(3) modulating means operatively associated with means (2) above for controlling the intensity of the exposure laser beam in response to input from a detection means of electrical or optical information such that the laser is caused to intermittently expose said master;

(4) charging means for electrostatically charging the photoconductive insulating surface of said master immediately prior to or after laser exposure;

(5) movable carriage means adapted for transverse movement across the surface of said master for charging and raster scanning the surface of the master by said laser scan line to form a latent electrostatic charge pattern in image configuration on said surface;

(6) a development station for electrostatic development of the latent electrostatic charge pattern on the surface of the master by contact with an electroscopic toner to form a visible image, and associated conveyor means for automatically transporting the master from the exposure platen through the development station;

(7) a fixing station for affixing or fusing said visible image to the master by means of heat, and associated conveyor means for automatically transporting the master from the development station through the fixing station; and (8) a decoding station for removing the non-imaged areas of the photoconductive insulating surface of the master by washing the surface with a decoating solution and associated conveyor means for automatically transporting the master from the fixing station fo the decoating station.

DETAILED DESCRIPTION OF THE INVENTION

Figure 1:
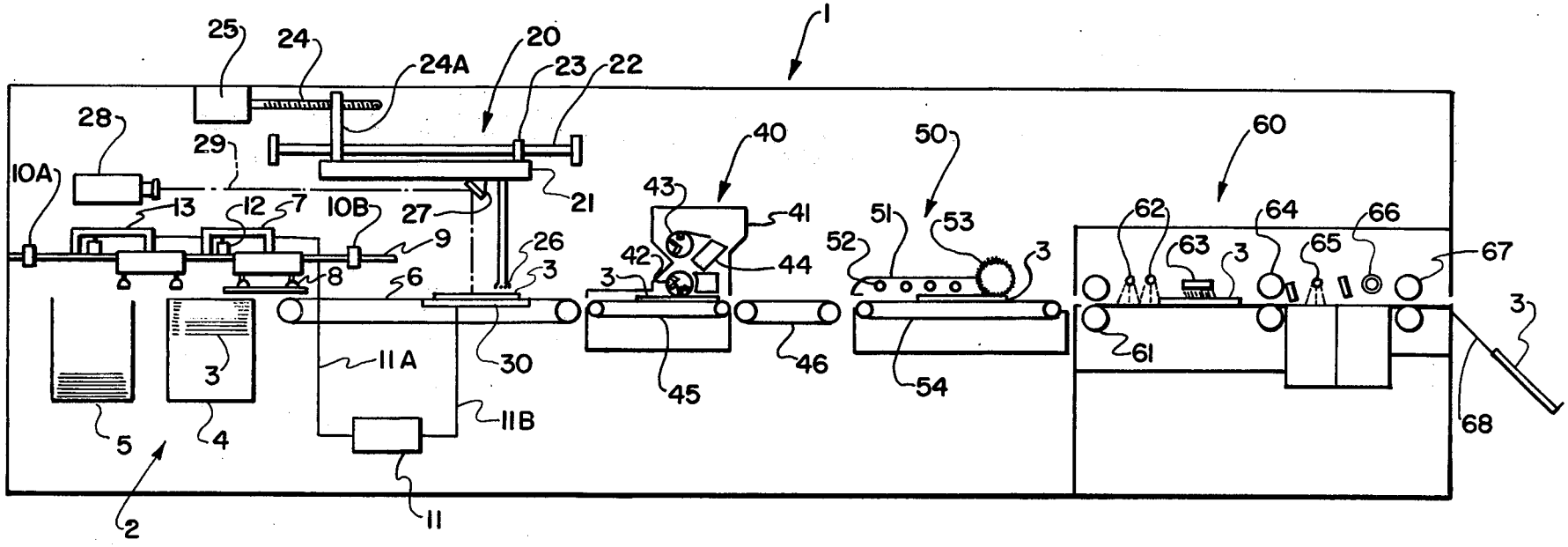
FIG. 1 is a partially schematic view depicting the various parts of the apparatus of this invention.

A specific machine of the invention is illustrated in partially schematic side view at 1 in FIG. 1 where selected dimensions have been exaggerated to facilitate understanding.

The printing master transport station is shown generally at 2. A supply of printing masters 3 are stored in stacking area 4. Because such masters are generally stacked with a piece of paper separating each master, a disposal area 5 is provided for such paper. In the preferred embodiment, the masters are transported from the stacking area to conveyor 6 by means of control arm mechanism 7 to which are attached a plurality of suction cup members, one of which is designated as 8. Arm 7 is pivotally attached to support arm 9 which is adapted for sliding lateral movement back and forth guided by sleeve mechanisms 10A and 10B. Arm 9 is in turn connected to a motor and gear mechanism for providing such back and forth motion (not shown), the construction of which would be evident to the skilled mechanic. Suction cup members 8 are in turn pneumatically connected to vacuum pump 11 through vacuum line 11A. When activated, the topmost printing master is engaged by at least four suction cup members 8 which adhere thereto by vacuum pressure. The cessation of air flow within suction cup members 8 causes arm 7 to pivot slightly upward by the action of a pneumatic piston 12 attached to arm 9 and arm 9 is mechanically driven toward conveyor 6. A release of vacuum causes arm 7 to pivot downward and deposit the master on the conveyor. At this point, a second mechanism 13 is positioned over the paper separation sheet at the top of the next master in line. When vacuum is once again applied, this mechanism engages the paper, picks it up, and transports it back to bin 5 for deposition therein by a procedure which is the reverse of the above-described plate transport procedure. The parts associated with control arm mechanism 13 are substantially identical to the parts associated with mechanism 7 and each of these mechanisms moves in synchronization with support arm 9 to which they are pivotally attached. Although this particular transport mechanism is preferred, other sheet feeding apparatus may be used such as disclosed and described in U.S. Pat. No. 4,006,984.

The exposure system of the apparatus is illustrated generally at 20. This system comprises a movable carriage platform 21 mounted on two rails, one of which is indicated at 22, via guide bearings or wheels, one of which is indicated at 23. A suitable threaded drive screw 24 associated with motor assembly 25 imparts translatory movement back and forth to carriage 21 by the action of the rotating drive screw 24 on a threaded nut section of post 24A which is rigidly attached to carriage 21. Attached to carriage 21 are corona charging device 26 and a light reflecting mirror 27. A source of scanning modulated laser light 28 is positioned such that light scan 29 emitted by the laser is deflected off mirror 27 and caused to impinge master 3 positioned at exposure platen 30 in a plane approximately perpendicular to the photoconductive surface of the master. As more specifically described in FIG. 2, the exposure platen has a plurality of holes on its upper surface and a lower chamber connected to vacuum pump 11 by means of vacuum line 11B such that the master sheet is securely retained on the platen by application of a vacuum after the master is positioned over the surface of the platen.

After the printing master has been exposed to form the latent electrostatic charge pattern in image configuration, the master is transported via belt conveyor 6 to and under development apparatus shown generally at 40. The development apparatus is of a type capable of developing an image on a flat carrier sheet by contact with electroscopic toner while the sheet is moving and while it is in a substantially horizontal plane. A liquid development apparatus such as disclosed in U.S. Pat. No. 3,999,511 may be employed for this purpose. The apparatus shown in FIG. 1 is a magnetic brush apparatus which sweeps the surface of the master with a developer "brush" cpmposed of a mixture of metal particles and a powdered resinous toner as the master passes thereunder. Basically this apparatus comprises a hopper 41 containing a lower magnetic brush 42 and an upper magnetic brush 43 arranged one above the other. These brushes are cylindrical hollow rolls having radially disposed rod magnets inside. Adjacent magnets have different polarities at the poles facing the shells of the rolls. Rolls 42 and 43 rotate in the same direction and by the resultant magnetic field which is directed vertically downward, the lower magnetic brush 42 sweeps the latent electrostatic image on printing master 3 as it passes underneath and deposits toner thereon in image configuration. Upper magnetic brush 43 serves to recycle developer to collecting compartment 44 for toner replenishment.

The master is continuously transported through the development station 40 by conveyor 45 and to and under the fixing apparatus shown generally at 50 by conveyors 46 and 54, where the toner in image configuration is fixed or fused to the surface of the printing master by the application of radiant heat. Where liquid development is used, the heat should be sufficient to dry the surface and cause the toner particles to adhere thereto. Where the toner is in the form of a resinous powder, the heat is sufficient to soften the powder and cause it to fuse to the surface. The apparatus shown in FIG. 1 comprises a heat deflecting shield 51 under which are mounted a plurality of heating coils, one of which is designated as 52. These coils may be elongated radiant elements or tubes containing an incandescent filament which extend over the entire width of printing master 3 as it passes under. At the discharge end of fixing apparatus 50 is mounted a rotatable motor drive cylindrical fan 53 having a plurality of vanes for cooling the master as it passes through.

From the fixing apparatus the imaged master is next transported to decoating apparatus shown generally at 60 for removal of the non-imaged areas of the photoconductive insulating layer such that the master will be suitable for use in an offset printing press. The decoating apparatus comprises a pair of cylindrical nip rollers 61 for receiving the master from conveyor 54, one of which is driven by a motor, to transport the master into the decoater. Recyclable decoater solution is pumped to and sprayed through cylindrical nozzels 62 onto the surface of the master and motor driven brush 63 is mounted to oscillate over the surface and in contact therewith as the master passes thereunder. Additional driven rollers 64 transport the master under a second washing station 65 and finally into a drying station 66 where heat is applied. The finished printing plate emerges from the apparatus by means of driven rollers 67 at catch plate 68.

Figure 2:
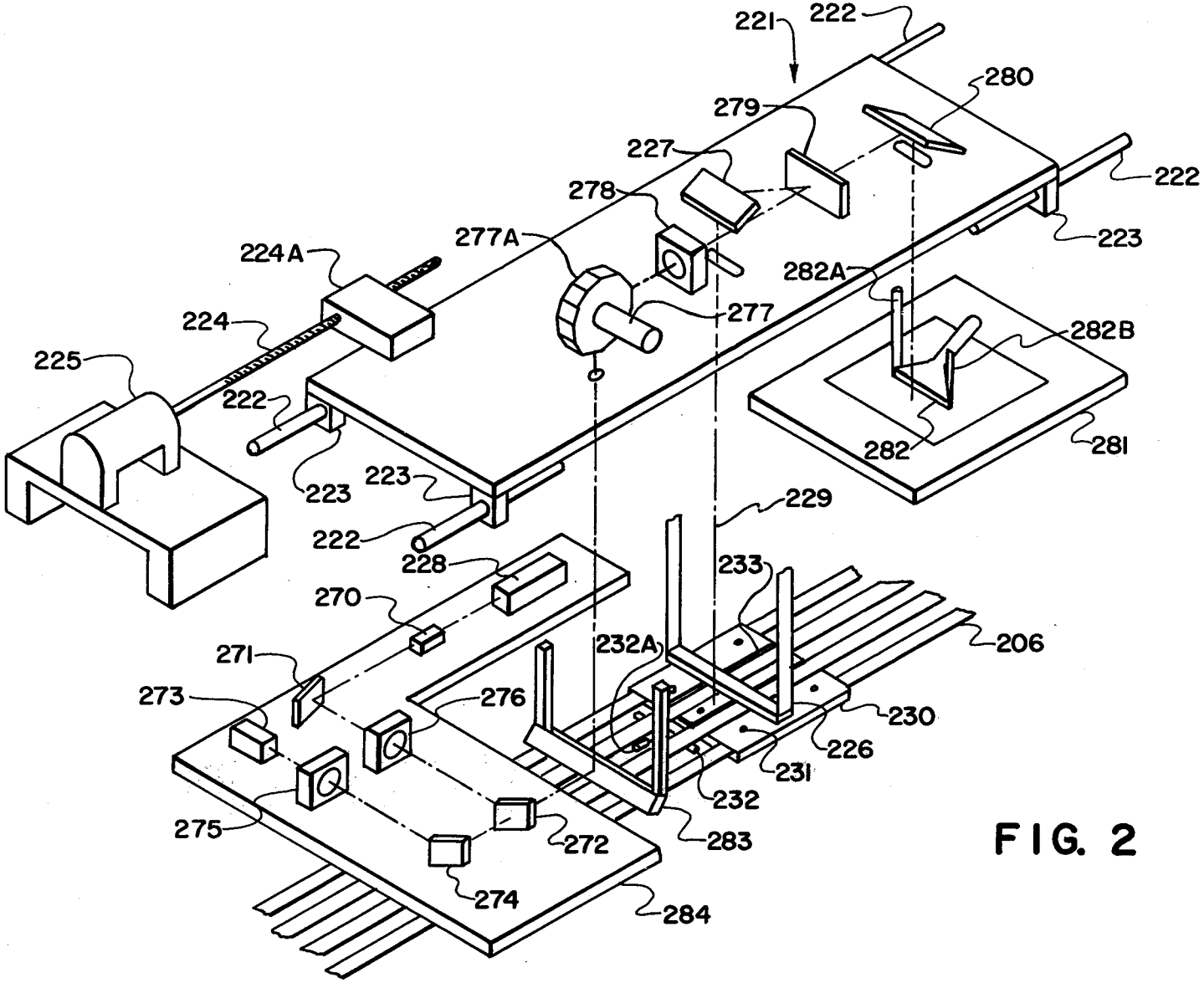
FIG. 2 is an isometric illustration with portions removed illustrating a laser read-write system for producing electrostatic image patterns on photoconductive printing masters.

Referring now to FIG. 2, the major elements of a laser and optics system suitable for use in the apparatus of this invention is illustrated. A write laser beam is generated by laser 228 and this beam is preferably in the actinic wavelength having a wavelength in the ultra violet and visible range. The output beam is passed through an optical modulator 270 either of the electro-optical or acousto-optical type which has the capability of deflecting the beam off at an angle in response to signals from a detection means as hereinafter described. When the beam is not deflected by the modulator, it is reflected off a deflecting folding mirror 271 and again reflected off the front surface of beam combiner 272, which front surface is coated with a dichroic material highly reflective toward actinic and/or UV radiation impinging thereon. A read laser beam is generated by laser 273 which emits light having a substantially different wavelength than the light emitted by write laser 228, for example, light in the red region of the spectrum such as emitted by a helium-neon laser. Light from this laser is deflected off folding mirror 274 and caused to impinge on the back side of beam combiner 272, which is substantially transmissive of light of this wavelength, at a point such that the write and read laser beams are merged and become substantially coincident. Prior to coincidence, each beam passes through beam expander systems 275 and 276, respectively, which systems may be simply a set of spherical mirrors plus an additional reflecting mirror (not shown). After passing through beam combiner 272, the beams are coincident and collimated to an appropriate diameter. The beams are then deflected by mirror 283, which is attached to movable carriage 221 and again reflected off scanner 277, which may be an oscillating mirror driven by a galvanometer or a series of mirrors 277A mounted on a rotating cylinder in a polygonal fashion similar to that disclosed in U.S. Pat. No. 3,966,319. The beams are then passed through objective or field flattener lens 278, which brings the beams to focus at the respective platen surfaces at a beam diameter of approximately 0.002 inches. The combined beam impinges on a surface beam splitter 279 which is a mirror similar to beam combiner 272 in that it transmits the read laser light but reflects the write laser light. The write laser beam 229 is thence directed to write platen 230 by reflecting mirror 227 such that it impinges the platen on a plane approximately perpendicular thereto. The read laser beam is transmitted by beam splitter 279 and deflected by one or two folding mirrors 280 to a read platen station 281 wherein an original document to be scanned is mounted such that it impinges the read platen in a plane approximately perpendicular thereto. Read platen 281 and exposure platen 230 are mounted in the apparatus parallel to one another and are stationary, whereas carriage 221 and the optical and charging system mounted thereon is adapted for transverse movement in a direction parallel to the respective platens such that the read laser and write laser will simultaneously raster scan the surfaces of an original document mounted on the read platen and a printing master positioned at the write platen, respectively.

The optical distances from scanner 277 to the respective platens 281 and 230 are arranged to be approximately the same in order to maintain unity image magnification. The non-specular reflected output from a document placed in the read platen is received by a detection means 282 mounted to carriage 221 by brackets 282A and 282B, which detection means comprises a fiber-optic array positioned at an angle and aimed toward the line of scan immediately below scanning mirror 280. This array is arranged in linear fashion as a line-to-point converter so that all possible reflective elements of the document are being seen simultaneously. The array is then regrouped into a small spot serving as the input to a photomultiplier tube, which in turn control the intensity permitted to be passed by modulator 270, which is electrically connected thereto. Modulator 270 can be set to operate either in the positive or negative mode, that is, it can be adjusted to transmit the write laser beam in response to either non-reflectance or reflectance from the original document as perceived by detection means 282. As is evident from FIG. 2, the laser and optical elements prior to deflecting mirror 283 are fixed and mounted on shelf 284, which is attached to the apparatus frame; the remaining optical elements are mounted on movable carriage 221.

Platen 230 is basically a vacuum plate connected to a vacuum pump (not shown) and having a plurality of holes 231 on the upper surface such that a printing master sheet transported to the platen will be securely retained by vacuum. The platen is channeled to form grooves 233 to permit two or more laps of belt conveyors 206 to pass below the upper surface level of the platen. Roller 232 controlled by pneumatic or solenoid means (not shown) deflects the conveyor upwardly for delivery of a master to the platen and downwardly at the point where the master is properly positioned over the platen for vacuum hold and exposure.

As previously indicated, the apparatus of the present invention which includes a laser/optics system such as described above is designed to operate at a relatively high speed and to utilize a very low power read and write laser. For example, the power of write laser 228 need not exceed 1 watt and is preferably in the range of about 5 to 20 milliwatts. The power of read laser 273 is considerably less and may be in the range of about 2 to 10 milliwatts. Specific lasers which may be employed include ruby, helium-neon, Krypton, argon-ion, or carbon dioxide, among others. The combination of lasers employed should be chosen such that they eimit light of different wavelengths which light can be combined and separated by an optical system such as described above. A particularly suitable read laser in the apparatus is a 4 milliwatt helium/neon laser emitting light operating in the TEM-00 mode at about 633 nm. A suitable write laser in the apparatus is a 16 milliwatt argon-ion laser emitting light operating in the TEM-00 mode at about 488 nm. The write laser should be capable of delivering a laser energy within the range of about $2\times10^{-3}$ to 30 millijoules/cm$^2$ at the surface of the write platen under operating conditions.

Figure 3:
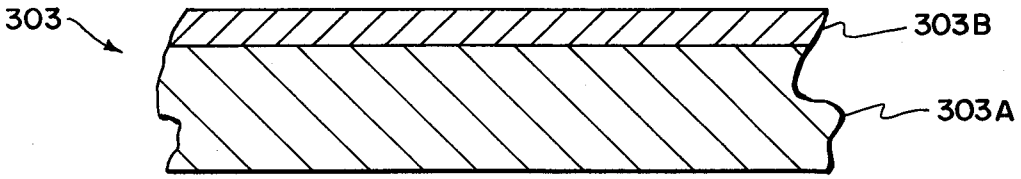
FIG. 3 is a sectioned side view of a suitable printing master for processing by the apparatus.

A side sectioned view of a printing master which may be electrophotographically exposed and developed in accordance with the present invention is shown in FIG. 3. The master 303 comprises a relatively conductive support sheet 303A having a photoconductive insulating layer 303B on the surface thereof. The support sheet may be metal, such as aluminum, zinc, magnesium or copper plates, and also of cellulose origin such as specially treated papers, cellulose hydrate, cellulose acetate or cellulose butyrate films. Some plastic materials, for example polyamides in film form or metal vaporized films, may also be used as supports.

Preferred photoconductors for use in the photoconductive insulating layer include inorganics such as zinc oxide, cadmium sulfide and the like, and organics such as the various oxazole compounds disclosed in U.S. Pat. No. 3,257,203, triphenylamine derivatives, higher condensed aromatic compounds such as anthracene, benzocondensed heterocyclic compounds, pyrazoline and imidazole derivatives, triazole and oxadiazole derivatives, and vinyl aromatic polymers such as polyvinyl anthracene, polyacenaphthylene, poly-N-vinylcarbazole, as well as copolymers thereof. The photoconductive insulating layer may also contain a resinous binder if desired, and a sensitizer which selectively sensitizes the photoconductive material to light in the wavelength emitted by the write laser, for example 400 to 550 n.m. Where the non-image areas of the photoconductive insulating layer are to be removed for offsetting printing, the photoconductive compound and binder, if present, should be suitable for solubility differentiation with respect to the toner covered image areas such that the non-image areas of the photoconductive insulating layer may be removed by decoater solution without affecting the toned image areas. Especially suitable printing plates for processing in accordance with the present invention are marketed under the trademark ELFASOL ® by the Kalle Division of Hoechst AG, of Wiesbaden, West Germany, and by the Azoplate Division of American Hoechst Corporation, of Murray Hill, N.J.

Figure 4:
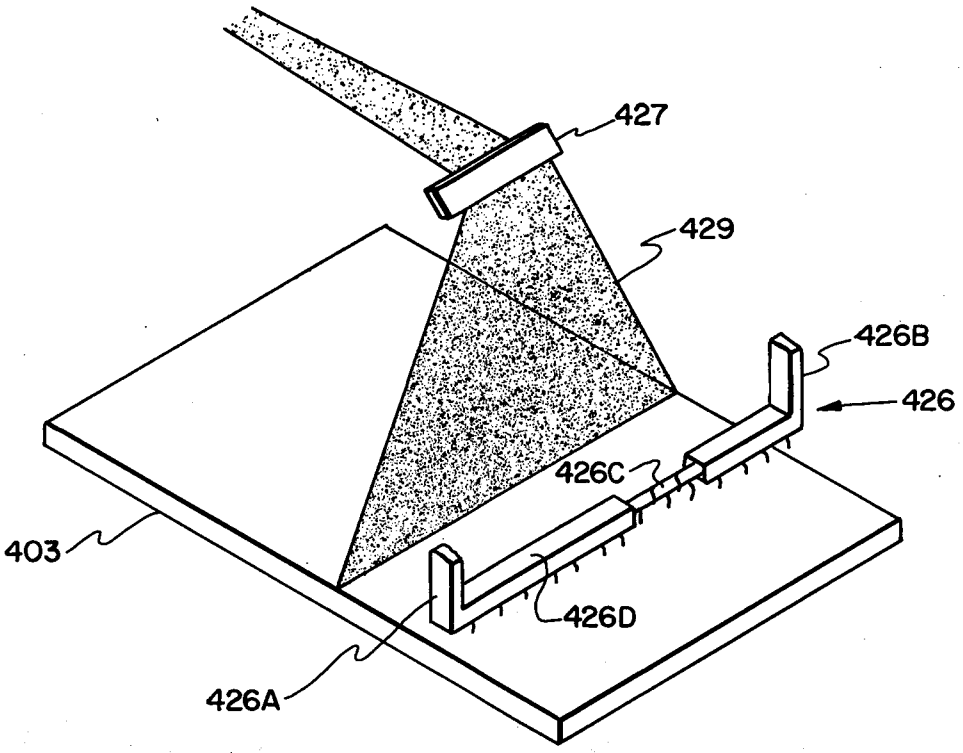
FIG. 4 is a perspective view illustrating the charging-/exposure sequence.

The charging/exposure sequence is illustrated in perspective in FIG. 4. Corona charging device 426 is supported by brackets 426A and 426B, which are cut off as shown but which are actually attached to movable carriage means 21 as shown in FIG. 1. The corona charging device comprises a grounded metal shield 426D supporting two corona wires shown in a cut off section at 426C, which corona wires are attached to a source of electrical potential. In operation, corona device 426 moves across the surface of master 403 in a left to right direction followed closely by the exposure line scan 429 as deflected by mirror 427 so as to impinge the master along a path substantially perpendicular thereto. In the preferred embodiment, both mirror 427 and corona charging device 426 are attached to the movable carriage means for synchronized transverse movement over master 403. Where the photoconductive insulating surface of the master is composed of a material which exhibits persistent conductivity characteristics, then the apparatus may be altered such that corona charging takes place immediately after exposure, in which case mirror 427 and corona device 426 would move in synchronization in a right to left direction.

Figure 5:
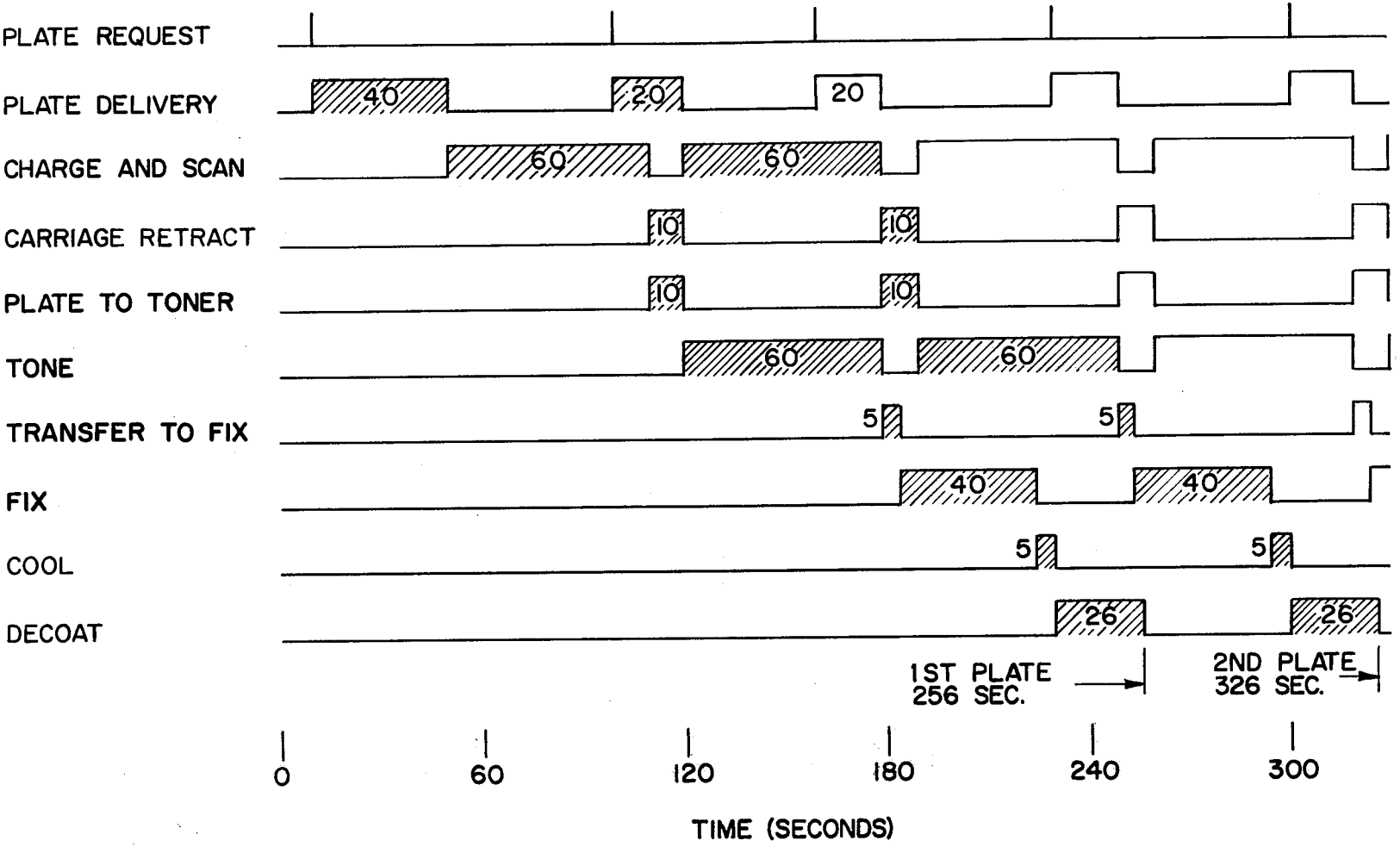
FIG. 5 is a time sequence diagram illustrating the programming sequence for automatic operation of the apparatus.

The apparatus of the present invention is programmed for automatic continuous operation by a series of trip switches positioned to control a time sequence as shown in FIG. 5. The apparatus is adapted to produce one finished printing plate in about one minute after an initial put through time of about 5 minutes for the first plate. As can be seen, and with additional reference to FIG. 1, delivery of the second plate to conveyor 6 is commenced while the first plate is being charged and scanned; delivery of the third plate is commenced while the first plate is being developed in developer station 40, and so forth.

The operation of the machine is basically as follows. When the machine is activated, the topmost printing master in stacking station 4 is pneumatically engaged by control arm mechanism 7, picked up by suction, and transported by the sliding action of arm 9 within sleeves 10A and 10B to deposit station over conveyor 6 by the action of the mechanism driving arm 9. When the plate reaches the conveyor deposit station, a trip switch valve closes the vacuum in line 11A, causing control arm 7 to pivot downwardly and deposit the plate, while control arm 13 also drops downwardly and vacuum engages a paper separator. Arm 9 returns to the home station and a second trip switch valve closes the vacuum associated with control arm 13 and opens the vacuum associated with control arm 7 such that the paper separator is deposited into storage bin 5 while control arm 7 is ready to engage a second plate.

Since conveyor belt 6 is continuously moving, the deposited plate advances thereon towards platen 30. Prior to reaching the platen, belt 6 is deflected upwardly by the pivoting action of roller 232 attached to a piston 232A as shown in FIG. 2, activated by a trip switch appropriately located along belt 6 for activation by the plate. This permits the plate to travel over platen 30. A second trip switch located at the far end of the platen is activated by the plate which causes roller 232 to drop, whereupon the plate is seated on the platen by a guide means. This switch also activates a valve in vacuum line 11B such that the plate is securely retained on the platen, and commences the charging scanning sequence. The charging corotron 26 advances across the plate surface followed closely by the laser scanning beam 29, all associated with and in synchronization with carriage 21, which is driven by motor 25. The photoconductive insulating layer of the plate is charged with a corona, the potential of which is, for example, negative or positive 4,500 to 6,000 volts, and exposed to a modulated laser scan line which is impinging the plate at a fixed distance behind, as illustrated in FIG. 4. Preferably, the time between charging and exposure is not more than 10 seconds. The linear speed of carriage 21 is approximately 21 inches per minute such that the length of a 14 by 21 inch plate can be traversed in approximately one minute.

After the carriage 21 has advanced to the point where the entire photoconductive surface of the plate has been scanned, a switch is activated which closes the valve in line 11B to release the platen vacuum, retracts carriage 21 back to the starting position at high speed through a variable reverse transmission system associated with motor 25, deactivates the charging and scanning systems and activates piston 232A, which pivots roller 232 back into contact with belt 6 for transport of the plate out of the exposure platen station. As the first plate exits the exposure platen station, a second plate is advanced into the station via a repeat of the aforementioned described sequence.

The exposed plate is transported via belt 6 to belt 45 for development with electroscopic toner. A trip switch associated with conveyor 45 is activated by the plate and starts a motor associated with developer unit 40. The plate is brushed with the developer material adhering to developer roller 42 as it passes beneath and toner is caused to adhere to those portions of the plate surface which retain an electrostatic charge. As the plate emerges from the developer station, the visible electrostatic image is evident.

All of the aforementioned operations are carried out in the absence of light or of actinic light which would expose the plates. Once the plate emerges from the developer unit, there is no requirement that the additional plate processing operations be conducted in the absence of light.

The developed plate is next transported to fixing station 50 via belt 46 where a series of switches deactivates developer 40 and activates the heat elements 52 and fan 53. The toner is thus fused to the surface of the printing plate. Next the plate is transported to decoating station 60 and past switches which deactivate the fixing station and activate the motor driven elements of the decoater. The non-image area of the photoconductive insulating layer is removed, the plate is dried, and the finished printing plate emerges on catch tray 68.

In the preferred embodiment of the invention, a system is provided for the reading of an original document having graphic indicia thereon such as a newspaper paste-up and the simultaneous line-for-line exposure of the photoconductive surface of the printing plate. In this system as illustrated in FIG. 2, the original document is mounted in read platen 281. At the start of the scan sequence, moving carriage 221 is advanced until a point where the read laser deflected by reflecting mirror 280 begins to scan the graphic indicia on the paste-up at the same time that the write laser 229 begins to scan the surface of the photoconductive plate. Because the laser optics are mounted on carriage 221, this operation is synchronous. The non-specular reflected output from the original document which is alternately dark or light is received by detection means 282, also mounted to and moving with carriage 221, which controls the output of the write laser as previously discussed. Thus, as the read beam crosses the light reflective areas of the original document, the write beam is simultaneously exposing the background areas on the photoconductive plate. When the read beam crosses dark or print areas on the document, the write beam is modulated so that the photoconductive plate is not exposed and retains the charge in those areas.

The apparatus of this invention may also be used for positional informational encoding such as required in facsimile transmissions. In such an apparatus the read platen station would be a grid or other position indicating network which, when passes over by the read beam, generates output pulses which are counted in an up-down counter to generate a binary member corresponding to the position of the read beam. Since the read beam is optically interlocked to the write beam, this member provides the accurate positional data required for high quality data transmission.

The following Example describes the process of this invention as carried out in the above-described apparatus.

EXAMPLE

The optical system of the apparatus as described in FIGS. 1 and 2 was equipped with a scanner composed of a rotating cylinder having a series of reflecting mirrors mounted in a polygonal fashion and adapted to rotate at a speed to produce a lateral laser scan speed of about 35,000 cm/sec. at the surfaces of the exposure and read platens. The apparatus was also equipped with a 16 milliwatt argon-ion exposure laser and a 4 milliwatt helium/neon read laser. An original newspaper paste-up having an image area of about 16 by 22 inches was placed in the read platen. A printing plate master comprising an aluminum base coated with a layer of photoconductive composition as described in U.S. Pat. No. 3,257,203 and also containing a dye sensitizer was transported to the platen area. The plate surface was charged by passing a corona charging device emitting a negative potential of 6,000 volts in a transverse direction over the photoconductive surface while the read and exposure lasers scanned the respective surfaces of the paste-up and the plate with a beam of collimated light having a diameter of 0.002 inches. The device was set such that the laser beam advanced approximately 1/1,000 inch for each lateral traverse of the beam over the plate surface. Operating in the positive mode, the exposure beam exposed those aeas of the photoconductive plate surface in response to white areas of the read platen as detected by the read laser, but was deflected or modulated such that no exposure of the photoconductive plate occurred in areas which correspond to dark areas of the read platen. The average energy density delivered to the photoconductive plate surface was less than 0.5 millijoules/cm$^2$. Total exposure time for a 15 by 21 inch area of photoconductive plate surface was about 1 minutes. After exposure, the latent electrostatic image was developed by contact with a pigmented resinous electroscopic toner, the image was fused by heat and the non-image area of the photoconductive plate surface was removed by washing with developer solution. The finished positive printing plate was then set up in an offset printing machine and inked in the known manner with a greasy ink which adheres to the imaged areas of the plate. The plate was found to be very durable in operation and gave a long printing run in excess of 40,000 impressions which accurately reproduced the original paste-up.

The method and apparatus of the present invention thus offers the advantages of a high speed and energy efficient technique for the production of offset printing plates which is of particular advantage in the newspaper and magazine printing industry. As many as 60 different plates may be prepared in one hour when an automated system is employed, resulting in a marked reduction of the time between paste-up and press run.

Although the apparatus of the present invention has been particularly described with reference to a specific system for generating modulated laser light for electrophotographic imagewise exposure of printing masters, it is to be emphasized that any suitable means may be employed. Thus, for example, the detection means for electrical or optical information may be a computer generated output which controls the modulation of the exposure or write laser in response to stored computer bits. The detection means may also comprise a fascimile receiver which controls the modulation of the exposure laser in response to electrical signals transmitted via telephone wires.

What I claim is:

1. An electrophotographic machine for forming an image on a printing master having a photoconductive surface including:

a. an exposure platen having a surface adapted to receive an unexposed printing master having a photoconductive surface thereon and to securely retain said master in a fixed plane;

b. an exposure laser having a power of less than about one watt and providing an exposure laser beam on the photoconductive surface of said printing master having an energy of at least about $2\times10^{-3}$ millijoules/cm$^2$, at said surface;

c. optical means including means for receiving said exposure laser beam, scanning and beam deflector optics means for scanning and deflecting said beam along a predetermined path to line scan a portion of the photoconductive surface of a printing master retained on said exposure platen;

d. modulating means for controlling the intensity of said exposure laser beam in response to input from a detection means of electrical or optical information;

e. charging means positioned adjacent to the surface of said exposure platen and mounted a fixed distance from said line scan for electrostatic charging of the photoconductive surface of a printing master retained in said platen;

f. movable carriage means supporting said beam deflecting and scanning means and adapted to traverse a plane substantially parallel to the plane of said exposure platen;

g. means for moving said carriage means and said charging means to establish relative transverse movement between said exposure platen on the one hand and said beam deflecting means and said charging means on the other hand and synchronous movement between said line scan and charging means, whereby the photoconductive surface of a printing master retained in said platen is electrostatically charged and raster scanned by said exposure laser as the result of such transverse relative movement to form a latent electrostatic charge pattern in image configuration on said surface;

h. developer means which comprises means for electrostatic development by contact of the latent electrostatic charge pattern on said photoconductive surface with toner to form a visible image and associated conveyor means for transporting the exposed printing master from said exposure platen to said developer means and;

i. fixing means which comprises means for permanently affixing said visible image to said master and associated conveyor means for transporting the developed printing master from said developer means to said fixing means.

2. The machine of claim 1 wherein said exposure laser beam is adapted to provide an energy on the photoconductive surface of a printing master within the range of about $2\times10^{-3}$ to 30 millijoules/cm$^2$.

3. The machine of claim 1 wherein said charging means is a corona wire charging device mounted on said movable carriage means at a fixed distance in advance of the line scan of said exposure laser beam.

4. The apparatus of claim 2 wherein said exposure laser has a power within the range of about 5 to 20 milliwatts.

5. The machine of claim 3 wherein said developer means comprises:

a. a magnetic brush developer unit including a rotatable metal cylinder having a plurality of stationary magnets disposed inside and a developer material comprising a mixture of resinous toner and metal particles adhering to the outer surface of said cylinder; and b. means for conveying said printing master on a substantially horizontal plane under said rotatable metal cylinder whereby said developer is caused to sweep the latent electrostatic charge pattern on the surface of said printing master and deposit toner thereon in image configuration as it passes under said rotating cylinder.

6. The machine of claim 5 wherein said fixing means comprises a heat chamber and includes a source of radiant heat for fusing said resinous toner to the surface of said master.

7. The machine of claim 3 further including decoating means for removing the non-imaged areas of the photoconductive surface of said printing master by washing said surface with decoating solution, and associated conveyor means for transporting said printing master from said fixing means to said decoating means.

8. The machine of claim 7 further including a stacking area for unexposed printing masters and conveyor means for transporting individual unexposed printing masters from said stacking area to the surface of said exposure platen.

9. The machine of claim 3 including a read platen adapted to retain an original having indicia thereon substantially parallel to and in a predetermined spaced relationship to said exposure platen, and means for generating a read laser beam having a light frequency different from the light frequency of said exposure laser beam for line scanning a portion of the surface of an original retained in said read platen, said read laser being the source of optical information to which said modulating means is responsive.

10. The machine of claim 9 wherein said optical means comprises:

a. combining optics means for merging said exposure and read laser beams into a single beam and delivering the merged beams to said scanning means, and deflector optics means for receiving the merged scanning beams and for deflecting said exposure laser beam on an optical path terminating on a path substantially perpendicular to said exposure platen while transmitting said read laser beam on an optical path terminating on a path substantially perpendicular to said read platen, said deflector optics means being mounted on said movable carriage means whereby an original document retained in said read platen is scanned by said read laser beam in synchronization with scanning of the photoconductive surface of said printing master retained in said exposure platen by said exposure laser beam; and b. indicia detection means comprising a line to spot fiber-optic array having its line input disposed adjacent to the line of said read laser beam at said read platen, said indicia detection means being electrically connected to said modulating means for controlling the exposure intensity of said exposure laser beam.

11. A continuous method for the production of printing masters comprising:

a. providing a supply of electrophotographic plates, said plates comprising a thin layer of photoconductive insulating composition coated on and adherent to a conductive base material;

b. continuously feeding one of said plates in timed sequence from said supply to an exposure platen to securely retain said plate in a fixed plane;

c. electrostatically charging said layer by passing a corona charging device over said layer;

d. exposing said layer to a modulated line scan beam of laser light, said laser having a power of less than one watt but sufficient power to provide a light energy on said layer of at least about $2\times10^{-3}$ millijoules/cm$^2$;

said charging and said exposing being conducted in synchronization such that the layer is charged and raster scanned by relative movement of said corona charging device and said modulated line scan beam over said layer to provide a latent electrostatic image on said layer;

e. transporting said plate from said exposure platen to a development station and developing said layer by contact of the latent electrostatic image with electrostatic toner to form a visible image; and f. transporting said plate from said development station to a fixing station and fusing of said visible image to the surface of said layer by the application of heat.

12. The method of claim 11 further including the step of:

g. transporting said plate from said fixing station to a decoating station and removing the non-imaged areas of said layer by washing the layer with decoating solution.

13. The method of claim 11 wherein the period of time between said synchronized charging and exposure is not more than 10 seconds.

14. The method of claim 11 wherein the light energy provided on said photoconductive layer is less than 0.5 millijoules/cm$^2$.

15. The method of claim 14 wherein said laser has a power within the range of about 5 to 20 milliwatts.

* * * * *